US006183930B1

(12) United States Patent
Ueda et al.

(10) Patent No.: US 6,183,930 B1
(45) Date of Patent: Feb. 6, 2001

(54) ELECTROPHOTOGRAPHIC PHOTOSENSITIVE MEMBER HAVING SURFACE OF NON-MONOCRYSTALLINE CARBON WITH CONTROLLED WEAR LOSS

(75) Inventors: Shigenori Ueda; Junichiro Hashizume, both of Nara; Makoto Aoki, Joyo, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/218,632

(22) Filed: Dec. 22, 1998

(30) Foreign Application Priority Data

Dec. 24, 1997 (JP) ..... 9-355337

(51) Int. Cl.[7] ..... G03G 21/00
(52) U.S. Cl. ..... 430/125; 399/350
(58) Field of Search ..... 430/125; 399/350

(56) References Cited

U.S. PATENT DOCUMENTS

| | | | | |
|---|---|---|---|---|
| 4,265,991 | | 5/1981 | Hirai et al. | 430/64 |
| 4,873,165 | | 10/1989 | Karakida et al. | 430/66 |
| 4,898,798 | | 2/1990 | Sugata et al. | 430/58 |
| 5,392,098 | | 2/1995 | Ehara et al. | 355/219 |
| 5,656,406 | * | 8/1997 | Ikuno et al. | 430/67 |
| 5,849,446 | | 12/1998 | Hashizume et al. | 430/67 |

FOREIGN PATENT DOCUMENTS

| | | | |
|---|---|---|---|
| 42-23910 | 11/1967 | (JP) . | |
| 43-24748 | 10/1968 | (JP) . | |
| 54-143149 | 11/1979 | (JP) | G03G/21/00 |
| 57-124777 | 8/1982 | (JP) | G03G/21/00 |
| 60-12554 | 1/1985 | (JP) | G03G/5/08 |
| 02111962 | 4/1990 | (JP) | G03G/5/08 |

OTHER PUBLICATIONS

Patent Abstracts of Japan, vol. 97, No. 6, (1997), JP 09–050217.

Patent Abstracts of Japan, vol. 97, No. 3 (1997), JP 08–292694.

* cited by examiner

*Primary Examiner*—Mark Chapman
(74) *Attorney, Agent, or Firm*—Fitzpatrick, Cella, Harper & Scinto

(57) ABSTRACT

For stably obtaining high-quality images with good cleaning properties, with neither occurrence of uneven scraping of a surface layer of a light receiving member nor fusion of a toner, and without occurrence of an image defect even without provision of a heater, the wear loss of the surface layer of a non-monocrystalline hydrogenated carbon film is made not less than 1 Å/10,000 sheets nor more than 10 Å/10,000 sheets after completion of copying processes of A4-size transfer sheets, each copying process including developing an image on a light receiving member with a developer having an average grain diameter of 5 to 8 μm, then transferring the developer image onto a transfer medium, and thereafter scrape-cleaning the surface of the light receiving member with an elastic rubber blade having the hardness of not less than 70 nor more than 80.

21 Claims, 4 Drawing Sheets

ELECTROPHOTOGRAPHIC PHOTOSENSITIVE MEMBER HAVING SURFACE OF NON-MONOCRYSTALLINE CARBON WITH CONTROLLED WEAR LOSS

BACKGROUND OF THE INVENTION

1. Field of the Invention

The present invention relates to an electrophotographic photosensitive member, an electrophotographic apparatus, and an electrophotographic method and, more particularly, to an electrophotographic photosensitive member, which is a light receiving member, an electrophotographic apparatus, and an electrophotographic method capable of providing high-quality images stably throughout a long period of time without image unfocussing or image smearing.

2. Related Background Art

Hitherto, there have been known many electrophotographic methods, for example, as described in U.S. Pat. No. 2,297,692, Japanese Patent Publication No. 42-23910, and Japanese Patent Publication No. 43-24748. It is common practice to utilize a light receiving member, form an electric latent image on the light receiving member by various means, then develop the latent image with a developing agent (developer), electrically transfer the developer image onto a transfer medium such as paper as occasion demands, and thereafter fix the image by heat, pressure, heat and pressure, or solvent vapor or the like to obtain a copy.

In the above steps, since the residual developer remains on the surface of the light receiving member even after the developer image has been transferred onto the transfer medium, a cleaning blade, used as a means for removing the residual developer, is put in contact with the surface of the light receiving member to scrape the residual developer therefrom and discharge the untransferred developer to the outside of the system.

As the materials for the light receiving member used as an electrophotographic photosensitive member, a variety of materials are suggested, including inorganic materials such as selenium, cadmium sulfide, zinc oxide, and amorphous silicon (hereinafter referred to as a-Si), organic materials, and so on. Of these materials, non-monocrystalline deposited films containing silicon atoms as a main component, typified by a-Si, for example amorphous deposited films of a-Si or the like containing hydrogen and/or halogen (for example, fluorine, chlorine, etc.) (for example, compensating for hydrogen or dangling bonds), are suggested as high-performance, high-durability, and nonpolluting photosensitive members and some of them are practically used. U.S. Pat. No. 4,265,991 discloses the technology of the electrophotographic photosensitive member, the photoconductive layer of which is formed mainly of a-Si. Japanese Patent Application Laid-Open No. 60-12554 discloses a surface layer containing carbon and halogen atoms in the surface of a photoconductive layer comprised of amorphous silicon containing silicon atoms, and Japanese Patent Application Laid-Open No. 2-111962 discloses a photosensitive member having a surface protecting-lubricating layer provided on an a-Si:H or a-C:H photosensitive layer. These all are techniques for enhancing water repellency and wear resistance and include no description concerning the relationship between the electrophotographic process and the scraping property of the surface layer.

Since the a-Si base photosensitive members, typified by a-Si, have excellent properties which demonstrate their high sensitivity to light of long wavelengths such as semiconductor lasers (770 nm to 800 nm) and have little deterioration recognized after repetitive use, they are widely used as photosensitive members for electrophotography, for example, in high-speed copying machines, LBPs (laser beam printers), and so on.

As the methods for forming the silicon base non-monocrystalline deposited films, there are many known methods, including the sputtering method, the method of decomposing a source gas by heat (thermal CVD method), the method of decomposing a source gas by light (photo CVD method), the method of decomposing a source gas by plasma (plasma CVD method), and so on. Of these methods, the plasma CVD method, which is a method of decomposing a source gas by a glow discharge or the like generated by direct current, high frequency (RF or VHF), or microwave to form a deposited film on a desired substrate such as glass, quartz, a heat-resistant synthetic resin film, stainless steel, or aluminum are now proceeding to practical use, including not only the method of forming the amorphous silicon deposited films for electrophotography, but also methods for forming deposited films for the other uses. There are also proposed various apparatuses for such methods.

Further, in the field of the application to the electrophotographic photosensitive members, demands for improvement in quality of film and processing performance are becoming stronger and stronger in recent years and a variety of ideas are also under study.

Particularly, the plasma processes using high-frequency power are used because of their various advantages including high stability of discharge, the capability of being also used for formation of insulating materials such as oxide films or nitride films, and so on.

For the light receiving members, there are recently required improvement in the electrophotographic characteristics matching with high-speed operation and more vivid image quality. Therefore, in addition to the improvement in the characteristics of the photosensitive member, the grain diameters of the developer are being decreased and there are frequently used those developers having a weight average grain diameter of 5 to 8 $\mu$m measured by a Coulter counter or the like.

Since the a-Si base light receiving members have surface hardnesses much higher than those of the other photosensitive members, a blade-type cleaning method with high cleaning ability is popularly used as a cleaning means.

However, in such a blade-type cleaning method, differences occur in the amounts of the developer remaining on the blade surface because of differences in character patterns in an original chart. Further, uneven scraping may occur in the surface layer of the light receiving member. When such uneven scraping occurs, sensitivity irregularities appear as electrophotographic characteristics and result in density irregularities in an image. This phenomenon becomes more prominent particularly as the grain diameters of the developer decrease. In recent years, because the decrease of the grain diameters of the developer is being advanced in order to meet the demands for higher quality of image characteristics, such density irregularities occur more readily.

Further, the decrease of grain diameters of the developer improves the quality of image on one hand while tending to increase scrubbing force on the other hand. This increase of scrubbing force causes the developer (toner) to slip through the cleaning blade because of chatter or the like of the cleaning blade and this slipping of the developer may cause a black-line-like cleaning failure. When the copying step is repeated in this state, fine particles of the developer and additives (strontium titanate, silica, etc.) contained in the developer may be scattered in a corona charger to adhere to a wire electrode of the corona charger (hereinafter referred to as a charger wire), thereby causing discharge irregularities. When the discharge irregularities due to the contamination of the charger wire are caused, in the case of positive development (a method of developing unexposed portions of the surface of the light receiving member), the quality of output image may be lowered by appearance of linear blank area portions on the image, scale-like black fog spreading over the entire image, local black dots (0.1 to 0.3 mmϕ) without periodicity, and so on.

Further, when the contamination of the charger wire is caused, abnormal discharge may be induced between the contaminated portion and the light receiving member, thus damaging the surface of the photosensitive member and causing image defects.

In addition, when the frictional resistance is high, friction heat is built up between the light receiving member and the cleaning blade, and this friction heat may cause a fusion phenomenon in which the developer used for thermal fixation firmly adheres to the surface of the light receiving member. Particularly, this fusion phenomenon becomes more prominent in proportion to the decrease of grain diameters of the developer. In the first stage the fusion phenomenon is too weak to affect the image; but repetitive use makes seeds of small areas of fused developer, gradually grows them and at last causes black-line-like image defects.

As the methods for solving the problems as described above, there are included a method of increasing the urging pressure of the cleaning blade, a method of increasing the hardness of the elastic rubber blade, and so on. However, these methods increase the friction force between the blade and the surface of the light receiving member, which may promote the uneven scraping of the surface layer. Further, the method of increasing the hardness of the blade may pose a problem that the material of the blade becomes fragile, whereby the lifetime of the blade is shortened.

As a countermeasure against such uneven scraping, there has hitherto been sometimes employed a method employing a means for providing a magnetic roller or a cleaning roller of urethane rubber, silicone rubber, or the like to uniformly spread the developer to reach the cleaning blade, thereby relaxing retention irregularities of the developer on the blade surface.

Another important role of the above magnetic roller or cleaning roller of urethane rubber, silicone rubber, or the like is to remove corona discharge products on the surface of the light receiving member.

The corona discharge products include nitrogen oxides (NOx) formed by oxidation of nitrogen in the air with ozone generated in corona discharge. Further, these nitrogen oxides react with water in the air to form nitric acid and other products. The products due to the corona discharge such as the nitrogen oxides, nitric acid, etc., adhere to and are deposited on the surface of the light receiving member and peripheral devices to contaminate their surfaces.

The corona discharge products have a strong hygroscopic property and the surface of the light receiving member adsorbing them substantially decreases its charge retaining capability throughout or in part of the surface because of the decrease of the resistance of the surface of the light receiving member caused by moisture absorption of the corona discharge products deposited thereon, which will be the cause of the image defect called image smearing (the charge in the surface of the light receiving member leaks in the plane directions to destroy or impede formation of an electrostatic latent image pattern).

Further, the corona discharge products adhering to the internal surface of a shield plate of the corona charger are evaporated and liberated not only during operation of the electrophotographic apparatus but also during quiescent periods of the apparatus, e.g. during the nighttime, and they then adhere to the surface of the light receiving member at a part thereof corresponding to the discharge aperture region of the charger. Since these corona discharge products absorb moisture to decrease the resistance of the surface of the light receiving member, it becomes easier to cause the image smearing called charger trace smearing in the first one or several copies outputted when restarting the operation after a long quiescent period of the electrophotographic apparatus, at the part of the light receiving member surface corresponding to the aperture region of the charger during the above quiescent period of the apparatus.

As a countermeasure for preventing this image smearing phenomenon, there has been provided a means for heating the surface of the light receiving member at about 30 to 50° C. by a heater for heating the light receiving member, a means for sending air to the light receiving member by a hot air sending device, or the like, in combination with the scrubbing means such as the cleaning roller, etc. described above. This heating means is sometimes used to lower the relative humidity to evaporate the corona discharge products adhering to the surface of the light receiving member and the water absorbed by the corona discharge products, thereby preventing the substantial decrease of the resistance of the surface of the light receiving member.

However, this heating means may cause image density irregularities of dark portions and light portions partially in image density at the period of rotation of a rotationally cylindrical developer carrier, where the size of the light receiving member and the thickness of the conductive substrate of the light receiving member are decreased with decrease in the size and cost of electrophotographic apparatus. The reason is that during the quiescent period of apparatus the heat of the light receiving member expands the rotationally cylindrical developer carrier to make irregular the distances to the facing portion of the light receiving member. The developer becomes easier to transfer in distance-shortened portions than usual.

In recent years, the tendency to personal use of copying machines and printers requires the important subjects of decrease of size, reduction of cost, and maintenance-free performance of the electrophotographic apparatuses. However, the provision of such a heating means is contrary to the requirement for the decrease of size, the reduction of cost, and the maintenance-free performance of the electrophotographic apparatuses. Further, in terms of further energy saving and ecology, the apparatus is also desirably designed without provision of the means for directly heating the light receiving member.

Moreover, in addition to the problem of image smearing, the technology for stably supplying high image quality is earnestly desired from recently growing needs for copy images. The uses of copying machines have been transferred from copy originals mainly including characters to images such as photographs, and the needs of market are increasing for copy images frequently using halftones. Therefore, severer standards than before are being demanded as to the stability of density.

Under such circumstances, there is a need for a light receiving member that does not cause image smearing and without provision of a heating means and a need for an electrophotographic apparatus that does not cause uneven scraping and that can stably supply high image quality without density irregularities under any electrophotographic process conditions.

SUMMARY OF THE INVENTION

The present invention has been accomplished in order to solve the above problems and an object of the invention is, therefore, to provide an electrophotographic photosensitive member, an electrophotographic apparatus, and an electrophotographic method free of the contamination of the charger wire, the cleaning failure, and the occurrence of fusion while preventing scattering of the developer, by using the light receiving member, the surface of the electrophotographic photosensitive member as the light receiving member uniformly wearing without uneven scraping even in the electrophotographic process for carrying out development with a developer of small grain diameters and cleaning by the cleaning method without the scrubbing means such as the cleaning roller or the like. A further object of the invention is to provide an electrophotographic photosensitive member, an electrophotographic apparatus, and an electrophotographic method that are free of occurrence of the image defect such as the image smearing under high humidity circumstances even without provision of the heating means for the light receiving member and the surface scrubbing means for the light receiving member. A still further object of the invention is to provide an electrophotographic photosensitive member, an electrophotographic apparatus, and an electrophotographic method capable of largely expanding the latitude of design of electrophotographic apparatus.

According to the present invention, there is provided an electrophotographic apparatus comprising an electrophotographic photosensitive member, and a charger, an exposure mechanism, a developing device, a transfer mechanism, and a cleaning means provided around the electrophotographic photosensitive member, wherein the cleaning means comprises a blade with an elasticity of a hardness of not less than 70 nor more than 80 for scrape-cleaning a surface of the electrophotographic photosensitive member, wherein the surface of the electrophotographic photosensitive member is formed of non-monocrystalline carbon containing hydrogen atoms, and wherein the wear loss of the surface during passage of A4-size transfer sheets with a developing agent of an average grain diameter of 5 to 8 μm is not less than 1 Å/10,000 sheets nor more than 10 Å/10,000 sheets.

According to the present invention, there is further provided an electrophotographic method of successively carrying out the steps of charging, exposure, development, transfer, and cleaning on an electrophotographic photosensitive member, wherein the development is carried out by use of a developing agent of an average grain diameter of 5 to 8 μm and the cleaning is carried out by use of an elastic blade with a hardness of not less than 70 nor more than 80, wherein the surface of the electrophotographic photosensitive member comprises non-monocrystalline carbon containing hydrogen atoms, and wherein when the above mentioned steps are successively carried out with regard to A4-size transfer sheets, the above mentioned steps are carried out such that the wear loss of the surface of the electrophotographic photosensitive member is not less than 1 Å/10,000 sheets nor more than 10 Å/10,000 sheets.

According to the present invention, there is still further provided an electrophotographic photosensitive member having a surface comprising non-monocrystalline carbon containing hydrogen atoms, the surface having a wear loss of not less than 1 Å nor more than 10 Å per 10,000 A4-size transfer sheets when effecting a process of carrying out charging, exposure, subsequent development with provision of a developing agent of an average grain diameter of 5 to 8 μm, subsequent transfer to a transfer sheet and subsequent scrape-cleaning with a blade having an elasticity of a hardness of not less than 70 nor more than 80.

DESCRIPTION OF THE PREFERRED EMBODIMENTS

Figure 1A:
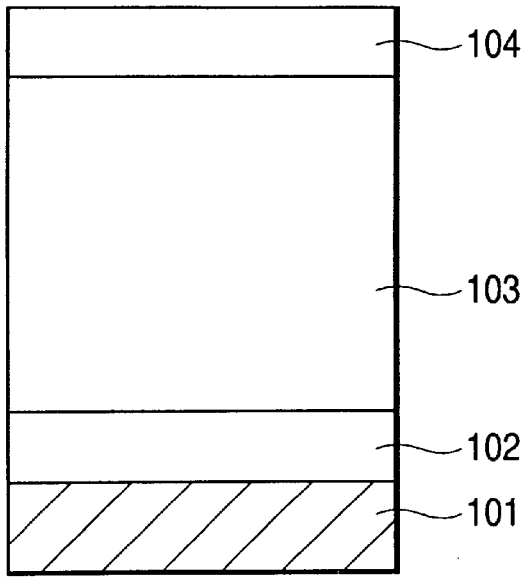
FIGS. 1A and 1B are schematic sectional views each showing a preferred example of the structure of the light receiving member (electrophotographic photosensitive member) of the present invention.

The inventors have focused attention on the relationship between the electrophotographic process and the wear loss (wear amount) of the surface layer of the light receiving member (electrophotographic photosensitive member) and attempted to improve the wear property of the surface of the light receiving member in a severe electrophotographic process as to uneven scraping. As a consequence, the inventors have found that the uneven scraping, cleaning failure, and fusion do not occur even in the severe structure of electrophotographic apparatus as to the uneven scraping, by employing a combination of the below-stated electrophotographic process with the light receiving member the surface layer of which was comprised of an a-C:H film as described below, and that the image smearing do not occur without provision of the heating means for the light receiving member in any environmental conditions.

Specifically, the inventors have found that excellent results are able to be achieved by the electrophotographic apparatus for successively carrying out charging, exposure, development, transfer, and cleaning while rotating the light receiving member, wherein when a developing agent having an average grain diameter of 5 to 8 μm is developed on the light receiving member and transferred to a transfer medium and the surface of the light receiving member after the transfer of the developing agent is scrape-cleaned with an elastic rubber blade having the hardness of not less than 70 nor more than 80, the surface layer of the light receiving member is comprised of a non-monocrystalline hydrogenated carbon film and the wear loss of the surface layer after copying steps on A4-size transfer sheets was not less than 1 Å/10,000 sheets nor more than 10 Å/10,000 sheets.

In the present invention, the hardness of the cleaning blade is preferably JIS (Japanese Industrial Standard) hardness (rubber hardness measured in type A in the measuring method of JIS K6301) of not less than 70 nor more than 80. The JIS standard K6301 (1975) for measuring rubber hardness according to Type A is disclosed on pages 10–15 of Revision No. JIS K6301-1995 as revised May 1, 1995 and published Sep. 20, 1995. When the hardness of the blade is over 80, the nature of the blade changes from a rubber-like state to a glass state, so that the material becomes fragile and tends to decrease the lifetime of the blade. When the hardness is below the JIS hardness 70, there sometimes arises problems of degradation of the cleaning performance, rolling of the blade resulting in damage of the surface of the light receiving member, and so on. As the materials for the cleaning blade used in the electrophotographic apparatus of the present invention, there are preferably employed urethane rubber, silicone rubber, butadiene rubber, isoprene rubber, nitrile rubber, natural rubber, and so on and particularly preferred materials are urethane rubber and silicone rubber in terms of the hardness and ease to process.

On the other hand, there are known as means for improving the cleaning property a grooved blade as described in Japanese Patent Application Laid-Open No. 54-143149, a projection-added blade as described in Japanese Patent Application Laid-Open No. 57-124777, and so on, but they describe nothing about the relationship between the electrophotographic apparatus using the developing agent of small grain diameters, not provided with the scrubbing means such as the cleaning roller, and not provided with the heating means for the light receiving member, and the wear loss of the surface of the light receiving member having the surface layer of amorphous hydrogenated carbon film.

In the present invention, the surface layer used for the light receiving member is comprised of a-C:H (hydrogen containing non-monocrystalline carbon, preferably amorphous carbon) and the hydrogen content of the film is 41% to 60%, based on a ratio of amount of H atoms/(amount of C atoms+amount of H atoms), and preferably 45% to 55%. If the hydrogen content is not more than 40%, the surface layer will not be suitable in sensitivity for the electrophotographic apparatus in certain cases. If the hydrogen content is over 60%, the denseness of the film will be deteriorated to decrease mechanical strength in certain cases.

When the surface layer, falling in the above range of the hydrogen content, is formed such that the wear loss after the copying steps on A4-size transfer sheets is in the range of not less than 1 Å/10,000 sheets nor more than 10 Å/10,000 sheets, the chatter of the blade due to friction rarely occurs and partial stress in the blade surface is suppressed, thereby relieving local retention of the developing agent. The inventors have found that as a consequence, the surface layer is uniformly worn without uneven scraping whereby the fusion is able to be prevented by the effect of scraping with the excellent cleaning property, without the scattering of toner, and without the contamination of wire. Further, the inventors have also found that the image smearing does not occur even under any environmental conditions with neither the means for heating the light receiving member nor the means for scrubbing the surface of the light receiving member, because the corona discharge products adhering to the surface of the light receiving member are efficiently and evenly scraped off by the uniform wearing of the surface layer.

If the wear loss of the surface layer of the light receiving member used in the present invention is larger than 10 Å/10,000 sheets, the mechanical strength could be degraded in certain cases. If the wear loss is smaller than 1 Å/10,000 sheets, the surface layer would become resistant to wearing to reduce the effect of scraping the corona discharge products, thereby causing the image smearing in certain cases.

Further, the optimum thickness of the surface layer used in the light receiving member of the present invention can be determined from the relationship between the wear loss of the surface layer and the lifetime of the electrophotographic apparatus, and it is generally in the range of 0.01 μm to 10 μm and preferably in the range of 0.1 μm to 1 μm. If the thickness of the surface layer is less than 0.01 μm, the mechanical strength could be degraded in certain cases. If the thickness is larger than 10 μm, the residual potential could become high in certain cases.

Embodiments of the present invention will be described with reference to the drawings.

Figure 1B:
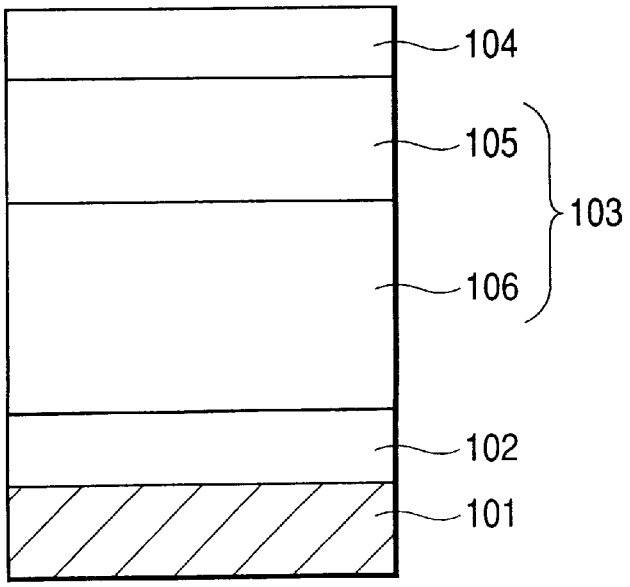

FIGS. 1A and 1B show examples of schematic cross sections of light receiving members according to the present invention. FIG. 1A shows an example of a single-layer type light receiving member in which the photoconductive layer is comprised of a single layer which is not functionally separated. FIG. 1B shows an example of a function-separated type light receiving member in which the photoconductive layer is separated into a charge generating layer and a charge transport layer.

The a-Si base light receiving member illustrated in FIG. 1A is composed of an electroconductive substrate 101 of aluminum or the like, and a charge injection inhibiting layer 102, a photoconductive layer 103, and a surface layer 104 stacked in this order on the surface of the conductive substrate 101. Here, the charge injection inhibiting layer 102 inhibits charge from being injected from the conductive substrate 101 into the photoconductive layer 103 and is provided as the occasion demands. The photoconductive layer 103 is comprised of an amorphous material containing at least silicon atoms and shows the photoconductive property. Further, the surface layer 104 is comprised of an a-C:H film containing carbon atoms and hydrogen atoms and has the capability of retaining a visible image in the electrophotographic apparatus.

In the following description it is assumed that the charge injection inhibiting layer 102 is present except when the effect differs depending upon either presence or absence of the charge injection inhibiting layer 102.

The a-Si base light receiving member illustrated in FIG. 1B is the light receiving member of the function-separated type in which the photoconductive layer 103 is comprised of a charge transport layer 106 made of an amorphous material containing at least silicon atoms and carbon atoms and a charge generating layer 105 made of an amorphous material containing at least silicon atoms, stacked in series. When this light receiving member is irradiated with light, carriers generated mainly in the charge generating layer 105 are transported through the charge transport layer 105 to reach the conductive substrate 101.

Incidentally, as the film-forming gases for the surface layer 104, there are preferably used gases of $CH_4$, $C_2H_6$, $C_3H_8$, $C_4H_{10}$, and so on, and gasifiable hydrocarbons. Further, when using these source gases for supply of carbon, they may be diluted with a gas such as $H_2$, He, Ar, or Ne, if necessary.

Figure 2:
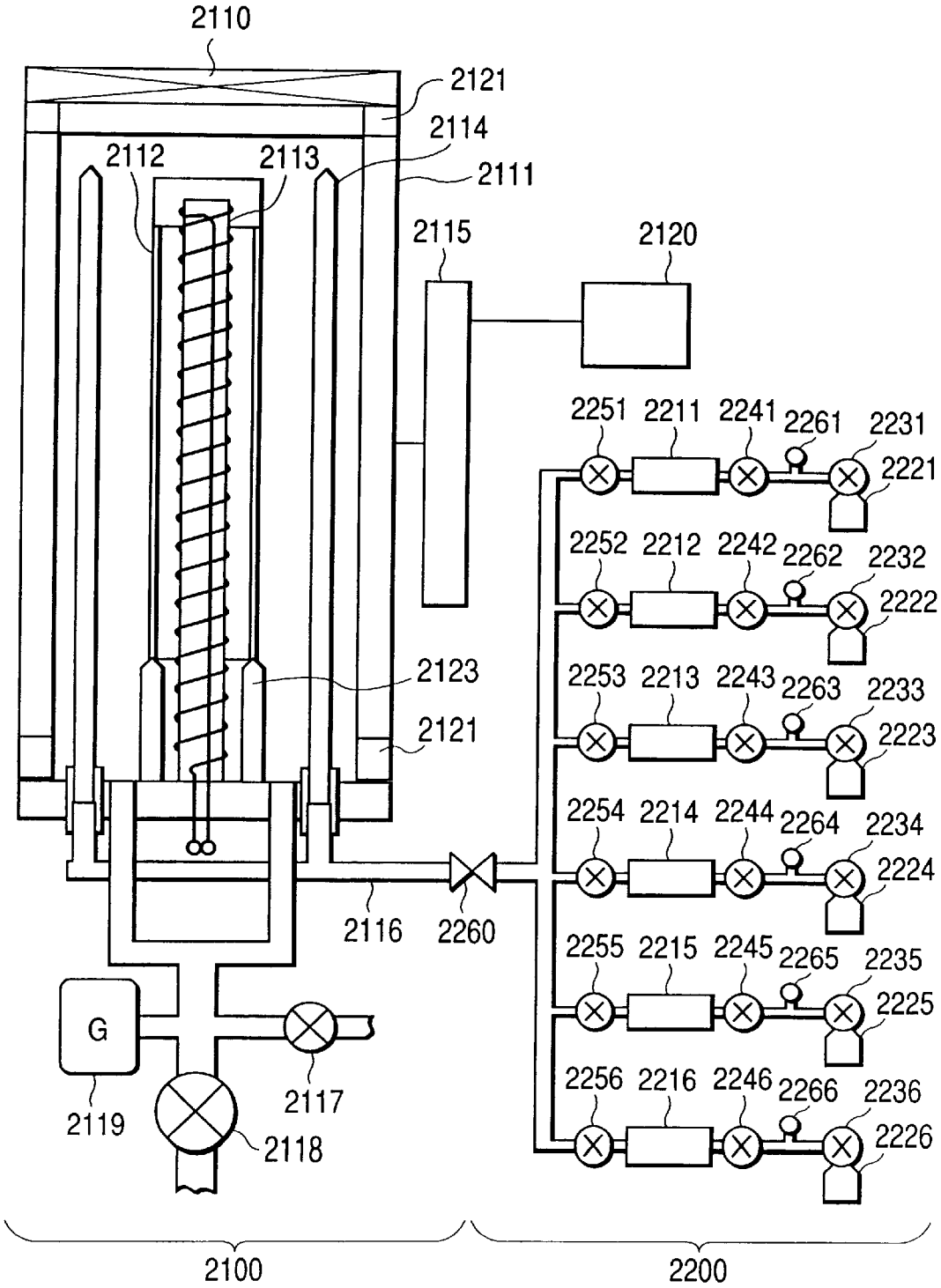
FIG. 2 is a schematic structural view showing an example of a deposition apparatus used for production of the light receiving member of the present invention.

FIG. 2 is a view schematically showing an example of an ordinary deposition apparatus for the light receiving member by the plasma CVD method.

This apparatus is generally composed of a deposition system 2100, a source gas supply system 2200, and an exhaust system (not illustrated) for reducing the pressure inside a reaction vessel 2110. Inside the reaction vessel 2110 in the deposition system 2100 there are a cylindrical film-formed substrate 2112 connected to the earth, a heater 2113 for heating the cylindrical film-forming substrate, and source gas inlet pipes 2114, and a high-frequency power source 2120 is connected to the vessel via a high-frequency matching box 2115.

The source gas supply system 2200 is composed of source gas cylinders 2221 to 2226 of $SiH_4$, $H_2$, $CH_4$, NO, $B_2H_6$, $CH_4$, etc., valves 2231 to 2236, 2241 to 2246, 2251 to 2256, and mass flow controllers 2211 to 2216, and the cylinders of the respective component gases are connected through a valve 2260 to the gas inlet pipes 2114 in the reaction vessel 2110. Numeral 2121 denotes an insulating material.

The cylindrical film-forming substrate 2112 is set on an electroconductive receiver 2123 to be earthed thereby.

Described below is an example of procedures in a forming method of the light receiving member, using the apparatus of FIG. 2.

The cylindrical film-forming substrate 2112 is set in the reaction vessel 2110 and the inside of the reaction vessel 2110 is evacuated by the exhaust system not illustrated (for example, a vacuum pump). Then the temperature of the cylindrical film-forming substrate 2112 is controlled to a desired temperature in the range of 20° C. to 500° C. by the heater 2113 for heating the cylindrical film-forming substrate. For letting the source gases for formation of the light receiving member into the reaction vessel 2110, after confirming that the valves 2231 to 2236 of the gas cylinders and a leak valve 2117 of the reaction vessel are closed and that the inflow valves 2241 to 2246, outflow valves 2251 to 2256, and auxiliary valve 2260 are opened, the main valve 2118 is next opened to evacuate the reaction vessel 2110 and gas supply pipe 2116.

After that, when a reading of vacuum gage 2119 reaches $5\times10^{-6}$ Torr, the auxiliary valve 2260 and outflow valves 2251 to 2256 are closed. Thereafter, each gas is introduced from the gas cylinder 2221 to 2226 with opening the corresponding valve 2231 to 2236 and the pressure of each gas is adjusted to 2 kg/cm$^2$ by pressure adjuster 2261 to 2266. The inflow valve 2241 to 2246 is then gradually opened to introduce each gas into the mass flow controller 2211 to 2216.

The above procedures complete preparation for film formation and thereafter formation of the photoconductive layer is first effected on the cylindrical film-forming substrate 2112.

When the cylindrical film-forming substrate 2112 reaches the desired temperature, necessary valves out of the outflow valves 2251 to 2256 and the auxiliary valve 2260 are gradually opened to introduce the desired source gases from the corresponding gas cylinders 2221 to 2226 through the gas inlet pipes 2114 into the reaction vessel 2110. Next, each source gas is regulated at a desired flow rate by each mass flow controller 2211 to 2216. On that occasion, the aperture of the main valve 2118 is adjusted with observing the vacuum gage 2119 so that the pressure inside the reaction vessel 2110 becomes the desired pressure of not more than 1 Torr. When the internal pressure becomes stable, the high-frequency power source 2120 is set to a desired power and the high-frequency power, for example, of the frequency in the range of 1 MHz to 450 MHz is supplied via the high-frequency matching box 2115 to the cathode electrode 2111 to induce a high-frequency glow discharge. This discharge energy decomposes each source gas introduced into the reaction vessel 2110, whereby the desired photoconductive layer with the matrix of silicon atoms is deposited on the cylindrical film-forming substrate 2112. After the film is formed in the desired thickness, the supply of the high-frequency power is stopped and each outflow valve 2251 to 2256 is closed to stop the inflow of each source gas into the reaction vessel 2110, thereby completing the formation of the photoconductive layer.

The composition and thickness of the photoconductive layer can be known ones.

The surface layer can also be formed on the above photoconductive layer basically by repeating the above operation.

Figure 3:
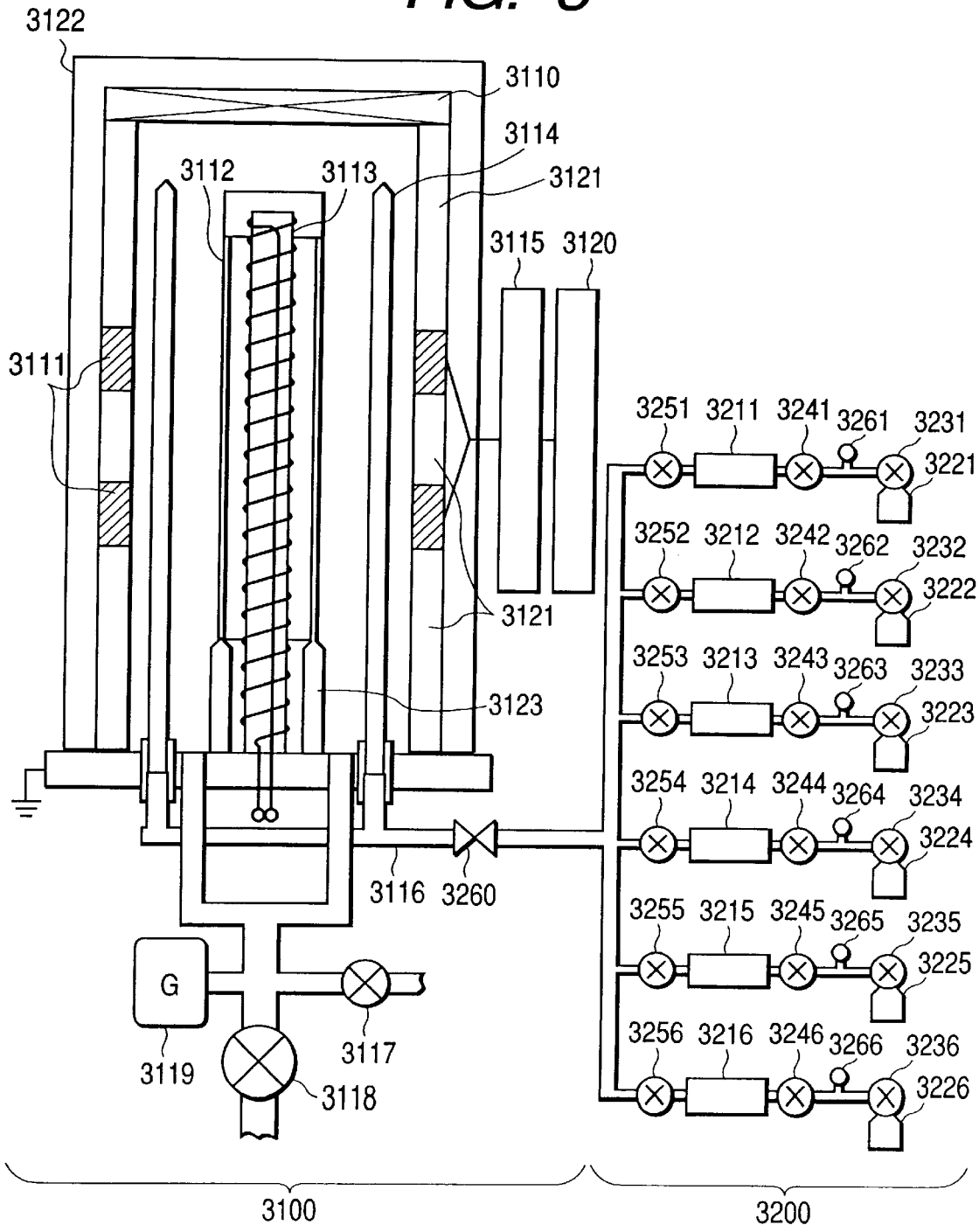
FIG. 3 is a schematic structural view showing another example of a deposition apparatus used for production of the light receiving member of the present invention.

FIG. 3 is a view schematically showing another example of the deposition apparatus for the light receiving member by the plasma CVD method using the high-frequency power source.

This apparatus is generally composed of a deposition system 3100, a source gas supply system 3200, and an exhaust system (not illustrated) for reducing the pressure inside a reaction vessel 3110. Inside the reaction vessel 3110 in the deposition system 3100 there are a cylindrical film-forming substrate 3112 connected to the earth, a heater 3113 for heating the cylindrical film-forming substrate, and source gas inlet pipes 3114, and a high-frequency power source 3120 is connected to the vessel via high-frequency matching box 3115.

The source gas supply system 3200 is composed of source gas cylinders 3221 to 3226 of $SiH_4$, $H_2$, $CH_4$, NO, $B_2H_6$, $CH_4$, etc., valves 3231 to 3236, 3241 to 3246, 3251 to 3256, and mass flow controllers 3211 to 3216, and the cylinders of the respective component gases are connected through a valve 3260 to the gas inlet pipes 3114 in the reaction vessel 3110.

The cylindrical film-forming substrate 3112 is set on an electroconductive receiver 3123 to be earthed thereby. Cathode electrode 3111 is made of an electroconductive material and is insulated by insulating material 3121. Numeral 3122 denotes an insulating shielding plate.

As the electroconductive material used for the electroconductive receiver 3123, there can be employed copper, aluminum, gold, platinum, lead, nickel, cobalt, iron, chromium, molybdenum, titanium, stainless steel, composite materials of two or more of these materials, and so on.

As the insulating material for insulating the cathode electrode 3111, there can be employed such insulating materials as ceramics, Teflon, mica, glass, quartz, silicone rubber, polyethylene, polypropylene, and so on.

The matching box 3115 preferably used herein is one of any structure as long as it can match the load with the high-frequency power source 3120. A preferred matching method is one to effect automatic matching, but a manual matching method can also be applied without affecting the effect of the present invention at all.

As the material for the cathode electrode 3111 to which the high-frequency power is applied, there can be employed copper, aluminum, gold, silver, platinum, lead, nickel, cobalt, iron, chromium, molybdenum, titanium, stainless steel, composite materials of two or more of these materials, and so on. The shape of the cathode electrode is preferably a cylindrical shape, but it may be elliptic or polygonal as occasion may demand.

The cathode electrode 3111 may be provided with a cooling means if necessary. As specific cooling means, cooling by water, air, liquid nitrogen, a Peltier element, or the like is used as occasion may demand.

The cylindrical film-forming substrate 3112 used in the present invention may be any one of a material and in a shape according to the purpose of use. For example, the shape is desirable cylindrical for production of the photosensitive member for electrophotography, but the shape may be a flat plate shape or any other shape as occasion may demand. Further, as the material therefor, there can be employed copper, aluminum, gold, silver, platinum, lead, nickel, cobalt, iron, chromium, molybdenum, titanium, stainless steel, composite materials of two or more of these materials, materials of such a structure that an electroconductive material covers an insulating material such as polyester, polyethylene, polycarbonate, cellulose acetate, polypropylene, polyvinyl chloride, polyvinylidene chloride, polystyrene, glass, quartz, ceramics, or paper, and so on.

Described below is an example of procedures in a forming method of the light receiving member, using the apparatus of FIG. 3.

The cylindrical film-forming substrate 3112 is set in the reaction vessel 3110 and the inside of the reaction vessel 3110 is evacuated by the exhaust system not illustrated (for example, a vacuum pump). Then the temperature of the cylindrical film-forming substrate 3112 is controlled to a desired temperature in the range of 20° C. to 500° C. by the heater 3113 for heating the cylindrical film-forming substrate.

For letting the source gases for formation of the light receiving member into the reaction vessel 3110, after confirming that the valves 3231 to 3236 of the gas cylinders and a leak valve 3117 of the reaction vessel are closed and that the inflow valves 3241 to 3246, outflow valves 3251 to 3256, and auxiliary valve 3260 are opened, a main valve 3118 is next opened to evacuate the reaction vessel 3110 and a gas supply pipe 3116.

After that, when a reading of a vacuum gage 3119 reaches $5\times10^{-6}$ Torr, the auxiliary valve 3260 and outflow valves 3251 to 3256 are closed. Thereafter, each gas is introduced from the gas cylinder 3221 to 3226 with opening the corresponding valve 3231 to 3236 and the pressure of each gas is adjusted to 2 kg/cm$^2$ by pressure adjuster 3261 to 3266. The inflow valve 2341 to 3246 is then gradually opened to introduce each gas into the mass flow controller 3211 to 3216.

The above procedures complete preparation for film formation and thereafter formation of the photoconductive layer is effected on the cylindrical film-forming substrate 3112.

When the cylindrical film-forming substrate 3112 reaches the desired temperature, necessary valves out of the outflow valves 3251 to 3256 and the auxiliary valve 3260 are gradually opened to introduce the desired source gases from the corresponding gas cylinders 3221 to 3226 through the gas inlet pipes 3114 into the reaction vessel 3110. Next, each source gas is regulated at a desired flow rate by each mass flow controller 3211 to 3216. On that occasion, the aperture of the main valve 3118 is adjusted with observing the vacuum gage 3119 so that the pressure inside the reaction vessel 3110 becomes the desired pressure of not more than 1 Torr. When the internal pressure becomes stable, the high-frequency power source 3120 is set to a desired power and the high-frequency power, for example, of the frequency in the range of 1 MHz to 450 MHz is supplied via the high-frequency matching box 3115 to the cathode electrode 3111 to induce a high-frequency glow discharge. This discharge energy decomposes each source gas introduced into the reaction vessel 3110, whereby the desired deposited film with the matrix of silicon atoms is deposited on the cylindrical film-forming substrate 3112. After the film is formed in the desired thickness, the supply of the high-frequency power is stopped and each outflow valve 3251 to 3256 is closed to stop the inflow of each source gas into the reaction vessel 3110, thereby completing the formation of the deposited film.

The surface layer of the present invention can also be formed basically by repeating the above operation.

Specifically, necessary valves out of the outflow valves 3251 to 3256 and the auxiliary valve 3260 are gradually opened to introduce source gases necessary for the surface layer from the corresponding gas cylinders 3221 to 3226 through the gas inlet pipes 3114 into the reaction vessel 3110. Then each source gas is adjusted to a predetermined flow rate by the corresponding mass flow controller 3211 to 3216. On that occasion, the aperture of the main valve 3118 is adjusted with observing the vacuum gage 3119 so that the pressure inside the reaction vessel 3110 becomes the predetermined pressure of not more than 1 Torr. When the internal pressure becomes stable, the high-frequency power source 3120 is set to a desired power and the high-frequency power of the frequency in the range of 1 MHz to 450 MHz is supplied via the high-frequency matching box 3115 to the cathode electrode 3111 to induce a high-frequency glow discharge. This discharge energy decomposes each source gas introduced into the reaction vessel 3110, whereby the surface layer is formed. After completion of the formation of the surface layer in the desired thickness, the supply of the high-frequency power is stopped and each outflow valve 3251 to 3256 is closed to stop the flow of each source gas into the reaction vessel 3110, thereby completing the formation of the surface layer.

Incidentally, the cylindrical film-forming substrate 3112 may be rotated at a predetermined speed by a driving device (not illustrated) during the period of film formation.

Figure 4:
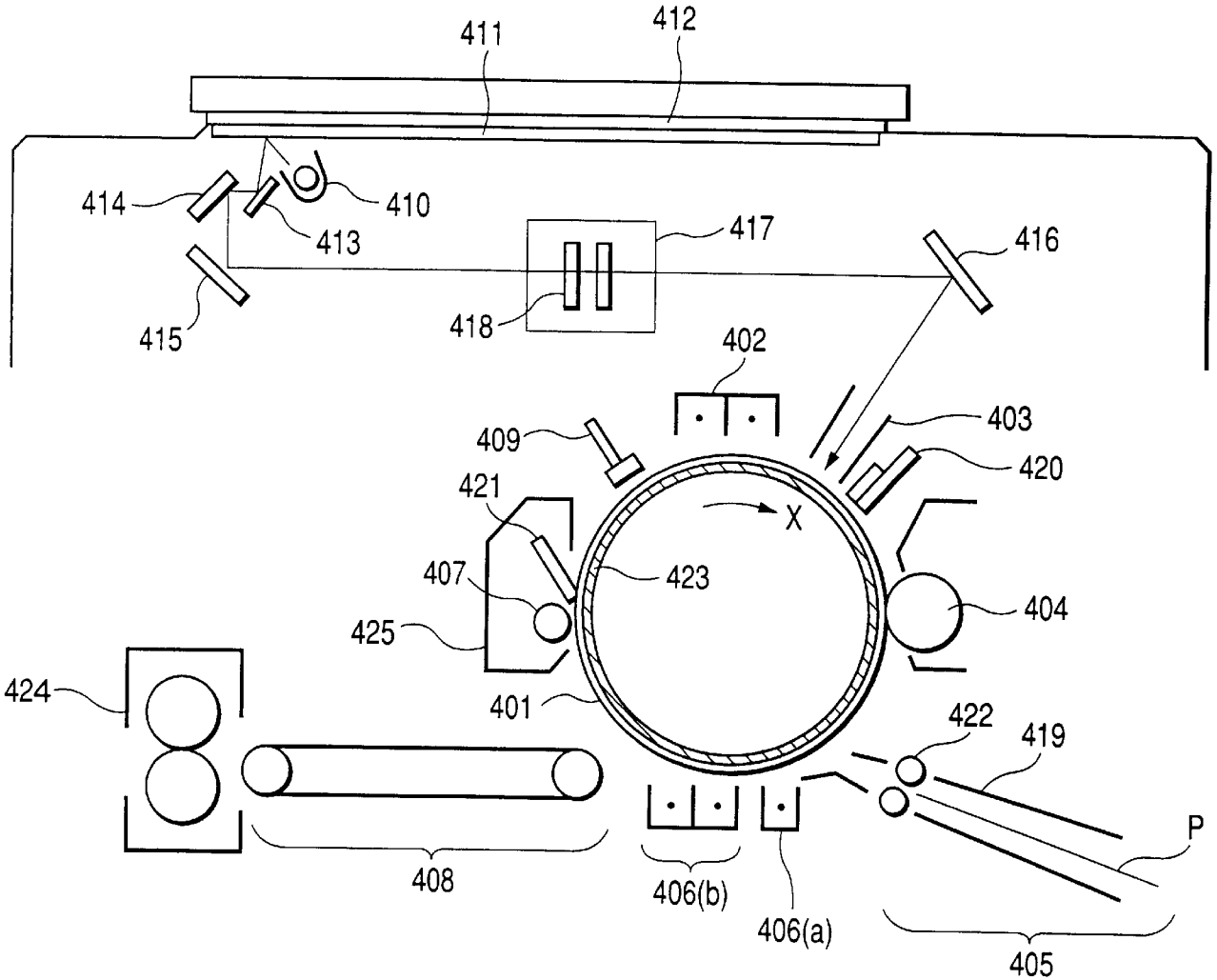
FIG. 4 is a schematic sectional view explaining an example of the electrophotographic apparatus.

FIG. 4 is a schematic view showing an example of the electrophotographic apparatus for explaining an example of an image forming process of the electrophotographic apparatus, in which the light receiving member 401 is arranged to be capable of being temperature-controlled by a surface heater 423 provided inside thereof and to be rotated in the direction of arrow X as occasion may demand. Around the light receiving member 401 there are provided a primary charger 402, an electrostatic latent image forming portion 403, a developing device 404, a transfer medium supplying system 405, a transfer charger 406(*a*), a separation charger 406(*b*), a cleaner 425, a conveying system 408, a charge-eliminating light source 409, and so on as occasion may demand.

Described below is a specific example of the image forming process. The light receiving member 401 is uniformly charged by the primary charger 402 to which the high voltage of +6–8 kV is applied. A light emitted from a lamp 410 is projected onto an original 412 placed on an original plate 411, the reflected light is guided via mirrors 413, 414, 415 to be focused by lenses 418 of a lens unit 417, the light is guided via a mirror 416 to be projected as an information carrying light onto an electrostatic latent image portion to form an electrostatic latent image on the light receiving member 401. A developer of the negative polarity is supplied from the developing device 404 onto the latent image to form a developer image. Incidentally, this exposure may also be carried out by scanning exposure with the information carrying light, using an LED array, a laser beam, or a liquid crystal shutter or the like, instead of the reflection from the original 412. Accordingly, the present invention also includes printers utilizing the so-called electrophotography.

On the other hand, a transfer medium P such as paper is supplied through the transfer medium supply system 405 toward the photosensitive member 401 while adjusting the leading-end supply timing by a registration roller 422. Numeral 419 denotes a transfer medium supply guide. The transfer medium P is given a positive electric field of the opposite polarity to that of the developer from the back surface in the gap between the transfer charger 406(*a*) to which the high voltage of +7 to 8 kV is applied, and the light receiving member 401, whereby the developer image of the negative polarity on the surface of the light receiving member is transferred onto the transfer medium P. Then the transfer medium P is separated from the light receiving member 401 by the separation charger 406(*b*) to which the high AC voltage of 12 to 14 kvp-p and 300 to 600 Hz is applied. Subsequently, the transfer medium P passes through the transfer conveying system 408 to a fixing device 424 to fix the developer image, and then the transfer medium is conveyed to the outside of the apparatus.

The developer remaining on the light receiving member 401 is collected by a cleaning roller 407 and a cleaning blade 421 made of an elastic material such as silicone rubber, urethane rubber, etc. provided in the cleaner 425, and the electrostatic latent image remaining thereon is erased by the charge-eliminating light source 409.

Numeral 420 designates a blank exposure LED, which is provided for exposing the light receiving member 401 to light with necessity so as to prevent the unwanted developer from adhering to portions outside the width of the transfer medium P and to non-image areas such as margin portions in the light receiving member 401.

EXAMPLES

The present invention will be described in further detail using examples thereof, but it should be noted that the present invention is by no means intended to be limited to these examples.

Example 1

Using the plasma CVD apparatus illustrated in FIG. 2, the light receiving members A, B, C were produced by stacking the inhibiting layer and the photoconductive layer on the cylindrical conductive substrate under the conditions of Table 1 and thereafter depositing the surface layer in a thickness of 0.5 μm under the conditions of Table 2. Further, a-H:C surface layer samples of A to C were each made under the conditions of Table 2 on a silicon wafer, as samples for measuring the hydrogen content of the surface layer.

With these surface layer samples of A to C, the hydrogen content H/(C+H) was measured by IR.

As a result, the hydrogen contents of the surface layers of the light receiving members A to C were the values shown in Table 3.

Then each of the light receiving members A to C was mounted in a modified machine from the copying machine NP-6060 manufacture by CANON K. K. and was evaluated as to the cleaning property by a durability test of continuous passage of 100,000 A4-size sheets (with conveying the A4-size ordinary sheet in the direction parallel to the short edge thereof). The cleaning conditions were set so as to effect scrape cleaning only by the elastic rubber blade 421 without provision of the cleaning roller 407. The elastic rubber blade 421 was an urethane rubber blade having the JIS hardness 70 and the developing agent used was one having the average grain diameter of 6.5 μm, because the fusion was likely to occur with smaller grain diameters of the developer. Further, the temperature of the surface of the light receiving member was controlled to 60° C. to obtain the condition under which the fusion became easier to occur.

The results obtained by the above evaluation are shown in Table 8. The wear losses of the surface layers after the durability test are also shown in Table 3. The wear losses of the surface layers were obtained by measuring the thicknesses of the surface layers before and after the durability test by a reflection spectroscopic interferometer and calculating the wear losses per 10,000 sheets from these values.

Further, the light receiving members of A to C were evaluated as to the image smearing by carrying out the durability test of 100,000 sheets under the environment of 35° C. and relative humidity 90% without provision of the heating means. The cleaning conditions herein were so set as to effect cleaning only by the elastic rubber blade 421 without provision of the cleaning roller 407 and effect such scrape cleaning that the urging pressure of the blade was 80% of the ordinary pressure.

The results obtained by the above evaluation are shown in Table 9. The light receiving members A, B, and C had neither the image defect of the black line pattern caused by uneven scraping even after the durability test of 100,000 sheets nor the image defects due to the cleaning failure, the fusion, and the like at all. Further, good image characteristics were also achieved as to the image smearing without provision of the heating means for the light receiving member.

(Evaluation method of uneven scraping)

The evaluation method of uneven scraping will be described using FIG. 4.

The charging current of the primary charger 402 is adjusted so that the dark area potential is 400 V at the position of the developing device 404. An original 412 having vertical lines of solid black is placed on the original plate 411. The durability test is conducted by having some portions always scrubbed with the developer and the other portions always not scrubbed therewith in the direction of the generating line of the surface of the light receiving member. After that, the charging current of the primary charger 402 is adjusted so that the dark area potential is 400 V at the position of the developing device 404. Then a solid white original 412 is placed on the original plate 411. The on voltage of the halogen lamp 410 is adjusted so that the light area potential is 50 V. After that, an original 412 with the reflection density of 0.3 is placed and potential irregularities are measured at this time. The potential irregularities are evaluated by percentage of change of a potential of an unevenly scraped portion to a potential of a normal portion.

Criteria for the evaluation are as follows.

a: Good image without sensitivity irregularities b: Image in practically acceptable level, though there are potential irregularities not more than 2.5% c: Image with linear, density irregularities while there are potential irregularities over 2.5%.

(Fusion evaluation method)

The evaluation method of fusion will be described referring to FIG. 4.

The charging current of the primary charger 402 is adjusted so that the dark area potential is 400 V at the position of the developing device 404. Then the original 412 of solid white is placed on the original plate 411. The on voltage of the halogen lamp 410 is adjusted so that the light area potential is 50 V. Thereafter, a solid white image of A3 size is made. This image is used to observe whether black dots appear due to the fusion of the developer and the surface of the light receiving member is also observed with a microscope.

Criteria for the evaluation are as follows.

a: Good image without fusion b: Image having no black dot while small fusion of not more than 10 μm is observed in the observation with the microscope (though it poses no practical problem)

c: Image having black dots (Cleaning failure evaluation method)

The evaluation method of cleaning failure will be described using FIG. 4.

The charging current of the primary charger 402 is adjusted so that the dark area potential is 400 V at the position of the developing device 404. The original 412 with the reflection density of 0.3 is placed on the original table 411. The on voltage of the halogen lamp 410 is adjusted so that the light area potential is 200 V, and a halftone image of A3 size is made. This image is used to observe whether a cleaning failure occurs in a linear pattern.

Criteria for the evaluation are as follows.

a: Good image without a cleaning failure b: Image in practically acceptable level, though there are two or less cleaning failures not greater than the width 1 mm and the length 1 cm c: Image possibly having three or more cleaning failures not greater than the width 1 mm and the length 1 cm or image possibly having a cleaning failure greater than the width 1 mm and the length 1 cm.

TABLE 1

| Production Conditions for Light Receiving Member | |
|---|---|
| Lower inhibiting layer | $SiH_4$ 300 sccm<br>$H_2$ 500 sccm<br>NO 8 sccm<br>$B_2H_6$ 2000 ppm<br>power 100 W (13.56 MHz)<br>inner pressure 0.4 Torr<br>thickness 1 $\mu$m |
| Photoconductive layer | $SiH_4$ 500 sccm<br>$H_2$ 500 sccm<br>power 400 W (13.56 MHz)<br>inner pressure 0.5 Torr<br>thickness 20 $\mu$m |

TABLE 2

| Production Conditions for Surface Layer in Example 1 (Surface layer) | |
|---|---|
| $CH_4$ | 500 sccm |
| Power | 1000 W (13.56 MHz) |
| Inner pressure (A) | 0.1 Torr |
| Inner pressure (B) | 0.3 Torr |
| Inner pressure (C) | 0.5 Torr |
| Substrate temperature | 200° C. |

TABLE 3

| Light receiving member | Wear loss (Å/10,000 sheets) | Hydrogen content (%) |
|---|---|---|
| A | 1 | 41 |
| B | 3 | 45 |
| C | 5 | 49 |

Comparative Example 1

In the similar fashion to Example 1, using the plasma CVD apparatus illustrated in FIG. 2, the light receiving members A', B', C' were produced by stacking the inhibiting layer and the photoconductive layer on the cylindrical conductive substrate under the conditions of Table 1 and thereafter depositing the surface layer in a thickness of 0.5 $\mu$m under the conditions of Table 4. Further, a-SiC surface layer samples of A' to C' were each prepared on the silicon wafer under the conditions of Table 4, and the hydrogen contents of the surface layers of A' to C' were measured by the similar method to that in Example 1.

As a result, the hydrogen contents of the surface layers of the light receiving members A' to C' were the values shown in Table 5.

Next, each of these light receiving members A' to C' was mounted in the modified machine from the copying machine NP-6060 manufacture by CANON K. K., and the durability test was conducted under the conditions similar to those in Example 1. The blade, however, was an urethane rubber blade having the JIS hardness 73. The wear losses of the surface layers after this durability test are shown in Table 5.

As a result, the image defect of the linear pattern due to uneven scraping occurred by the durability test of 100,000 sheets. Further, the image smearing was evaluated by the durability test under the conditions without the heating means for the light receiving member and without the cleaning roller, and the image smearing occurred to obtain no good image.

TABLE 4

| Production Conditions for Surface Layer in Comparative Example 1 (Surface layer) | |
|---|---|
| $SiH_4/CH_4$ | 50 sccm/50 sccm |
| Power (A') | 100 W (13.56 MHz) |
| Power (B') | 200 W (13.56 MHz) |
| Power (C') | 300 W (13.56 MHz) |
| Temperature | 250° C. |
| Inner pressure | 0.3 Torr |

TABLE 5

| Light receiving member | Wear loss (Å/10,000 sheets) | Hydrogen content (%) |
|---|---|---|
| A' | 6 | 56 |
| B' | 5 | 44 |
| C' | 1 | 39 |

Example 2

In the similar fashion to Example 1, using the plasma CVD apparatus illustrated in FIG. 2, the light receiving members D, E, F were produced by stacking the inhibiting layer and the photoconductive layer on the cylindrical conductive substrate under the conditions of Table 1 and thereafter depositing the surface layer in a thickness of 0.5 $\mu$m under the conditions of Table 6. Further, a-C:H surface layer samples of D to F were each prepared on the silicon wafer under the conditions of Table 6, and the hydrogen contents of the surface layers of D to F were measured by the similar method to that in Example 1.

As a result, the hydrogen contents of the surface layers of the light receiving members D to F were the values shown in Table 7. Next, each of these light receiving members D to F was mounted in the modified machine from the copying machine NP-6060 manufacture by CANON K. K., and the durability test was conducted under the conditions similar to those in Example 1. The blade, however, was the urethane rubber blade having the JIS hardness 73. The wear losses of the surface layers after this durability test are shown in Table 7.

The results obtained by the above evaluations are shown in Table 8 and Table 9. As a result, the light receiving members D to F had neither the image defect of the linear pattern caused by the uneven scraping even after the durability test of 100,000 sheets nor the image defects due to cleaning failure, fusion, and the like at all. Further, concerning the image smearing, good image characteristics were obtained without provision of the heating means for the light receiving member.

TABLE 6

| Production Conditions for Surface Layer in Example 2 (Surface layer) | |
|---|---|
| $CH_4/H_2$ | 100 sccm/200 sccm |
| Power | 500 W (13.56 MHz) |
| Temperature (D) | 150° C. |
| Temperature (E) | 200° C. |
| Temperature (F) | 250° C. |
| Inner pressure | 0.3 Torr |

TABLE 7

| Light receiving member | Wear loss (Å/10,000 sheets) | Hydrogen content (%) |
|---|---|---|
| D | 10 | 60 |
| E | 8 | 58 |
| F | 6 | 55 |

TABLE 8

| Light receiving member | Uneven scraping | Fusion | Cleaning failure |
|---|---|---|---|
| A | a | a | a |
| B | a | a | a |
| C | a | a | a |
| D | a | a | a |
| E | a | a | a |
| F | a | a | a |

TABLE 9

| Light receiving member | 10,000 sheets | 30,000 sheets | 50,000 sheets | 80,000 sheets | 100,000 sheets |
|---|---|---|---|---|---|
| A | a | a | a | a | a |
| B | a | a | a | a | a |
| C | a | a | a | a | a |
| D | a | a | a | a | a |
| E | a | a | a | a | a |
| F | a | a | a | a | a |

a: Good image without image smearing
b: Image in such a practically acceptable level that lines in the density of 7 lines/mm are not seen but lines in the density of 6 lines/mm are seen
c: Image possibly having image smearing in such a level that lines in the density of 5 lines/mm are not seen

Comparative Example 2

In the similar fashion to Example 1, using the plasma CVD apparatus illustrated in FIG. 2, the light receiving members D', E', F' were produced by stacking the inhibiting layer and the photoconductive layer on the cylindrical conductive substrate under the conditions of Table 1 and thereafter depositing the surface layer in a thickness of 0.5 μm under the conditions of Table 10. Further, a-SiC surface layer samples of D' to F' were each prepared on the silicon wafer under the conditions of Table 10, and the hydrogen contents of the surface layers of D' to F' were measured by the similar method to that in Example 1. As a result, the hydrogen contents of the surface layers of the light receiving members D' to F' were the values shown in Table 11.

Next, each of these light receiving members D' to F' was mounted in the modified machine from the copie6r NP-6060 manufacture by CANON K. K., and the durability test was conducted under the conditions similar to those in Example 1. The blade, however, was the urethane rubber blade having the JIS hardness 73. The wear losses of the surface layers after this durability test are shown in Table 11.

The results obtained by the above evaluations are shown in Table 12 and Table 13. As a result, the image defect of the linear pattern due to uneven scraping occurred by the durability test of 100,000 sheets. Further, the image smearing was evaluated by the durability test under the conditions without the heating means for the light receiving member and without the cleaning roller, and the image smearing occurred to obtain no good image.

TABLE 10

| Production Conditions for Surface Layer in Comparative Example 2 (Surface layer) | |
|---|---|
| $SiH_4/CH_4$ | 50 sccm/30 sccm |
| Power (D') | 50 W (13.56 MHz) |
| Power (E') | 150 W (13.56 MHz) |
| Power (F') | 250 W (13.56 MHz) |
| Temperature | 250° C. |
| Inner pressure | 0.3 Torr |

TABLE 11

| Light receiving member | Wear loss (Å/10,000 sheets) | Hydrogen content (%) |
|---|---|---|
| D' | 10 | 66 |
| E' | 9 | 62 |
| F' | 6 | 59 |

TABLE 12

| Light receiving member | Uneven scraping | Fusion | Cleaning failure |
|---|---|---|---|
| A' | c | b | c |
| B' | c | b | c |
| C' | c | c | c |
| D' | c | a | c |
| E' | c | a | c |
| F' | c | b | c |

TABLE 13

| Light receiving member | 10,000 sheets | 30,000 sheets | 50,000 sheets | 80,000 sheets | 100,000 sheets |
|---|---|---|---|---|---|
| A' | a | a | b | b | c |
| B' | a | b | b | c | c |
| C' | a | b | c | c | c |
| D' | a | a | a | b | c |

TABLE 13-continued

| Light receiving member | 10,000 sheets | 30,000 sheets | 50,000 sheets | 80,000 sheets | 100,000 sheets |
|---|---|---|---|---|---|
| E' | a | a | b | b | c |
| F' | a | b | b | b | c |

a: Good image without image smearing
b: Image in such a practically acceptable level that lines in the density of 7 lines/mm are not seen but lines in the density of 6 lines/mm are seen
c: Image possibly having image smearing in such a level that lines in the density of 5 lines/mm are not seen

Example 3

In the similar fashion to Example 1, using the plasma CVD apparatus illustrated in FIG. 3, the light receiving members G, H, I were produced by stacking the inhibiting layer and the photoconductive layer on the cylindrical conductive substrate under the conditions of Table 14 and thereafter depositing the surface layer in a thickness of 0.5 μm under the conditions of Table 15. Further, a-C:H surface layer samples of G to I were each prepared on the silicon wafer under the conditions of Table 15, and the hydrogen contents of the surface layers of G to I were measured by the similar method to that in Example 1. As a result, the hydrogen contents of the surface layers of the light receiving members G to I were the values shown in Table 16.

Next, each of these light receiving members G to I was mounted in the modified machine from the copying machine NP-6060 manufacture by CANON K. K., and the durability test was conducted under the conditions similar to those in Example 1. The blade, however, was a silicone rubber blade having the JIS hardness 76. The wear losses of the surface layers after this durability test are shown in Table 16.

The results obtained by the above evaluations are shown in Table 21 and Table 22.

As a result, neither of the light receiving members G to I experienced the image defect of the linear pattern caused by the uneven scraping even after the durability test of 100,000 sheets and the image defect due to cleaning failure, fusion, or the like at all. Further, concerning the image smearing, good image characteristics were obtained without provision of the heating means of the light receiving member.

TABLE 14

| Production Conditions for Light Receiving Member | |
|---|---|
| Lower inhibiting layer | $SiH_4$ 300 sccm<br>$H_2$ 500 sccm<br>$B_2H_6$ 2000 ppm<br>power 100 W (105 MHz)<br>inner pressure 20 mTorr<br>thickness 1 μm |
| Charge transport layer | $SiH_4$ 500 sccm<br>$H_2$ 500 sccm<br>$CH_4$ 50 sccm<br>power 300 W (105 MHz)<br>inner pressure 20 mTorr<br>thickness 15 μm |
| Charge generating layer | $SiH_4$ 500 sccm<br>$H_2$ 500 sccm<br>power 300 W (105 MHz)<br>inner pressure 20 mTorr<br>thickness 5 μm |

TABLE 15

| Production Conditions for Surface Layer in Example 3 (Surface layer) | |
|---|---|
| $CH_4$ | 500 sccm |
| Power | 1000 W (105 MHz) |
| Inner pressure (G) | 1 mTorr |
| Inner pressure (H) | 50 mTorr |
| Inner pressure (I) | 100 mTorr |
| Substrate temperature | 200° C. |

TABLE 16

| Light receiving member | Wear loss (Å/10,000 sheets) | Hydrogen content (%) |
|---|---|---|
| G | 1 | 41 |
| H | 3 | 45 |
| I | 5 | 49 |

Comparative Example 3

In the similar fashion to Example 1, using the plasma CVD apparatus illustrated in FIG. 3, the light receiving members G', H', I' were produced by stacking the inhibiting layer and the photoconductive layer on the cylindrical conductive substrate under the conditions of Table 14 and thereafter depositing the surface layer in a thickness of 0.5 μm under the conditions of Table 17. Further, a-C:H surface layer samples of G' to I' were each prepared on the silicon wafer under the conditions of Table 17, and the hydrogen contents of the surface layers of G' to I' were measured by the similar method to that in Example 1.

As a result, the hydrogen contents of the surface layers of the light receiving members G' to I' were the values shown in Table 18.

Next, each of these light receiving members G' to I' was mounted in the modified machine from the copying machine NP-6060 manufacture by CANON K. K., and the durability test was conducted under the conditions similar to those in Example 1. The blade, however, was the silicone rubber blade having the JIS hardness 73. The wear losses of the surface layers after this durability test are shown in Table 18.

The results obtained by the above evaluations are shown in Table 25 and Table 26.

As a result, it was found that the durability test of 100,000 sheets sometimes resulted in uneven scraping, fusion, and image smearing in the case of the a-C:H films where the wear loss was smaller than 1 Å/10,000 sheets and the hydrogen content was less than 41%.

TABLE 17

| Production Conditions for Surface Layer in Comparative Example 3 (Surface layer) | |
|---|---|
| $CH_4$ | 500 sccm |
| Power (G') | 800 W (13.56 MHz) |
| Power (H') | 1000 W (13.56 MHz) |
| Power (I') | 1500 W (13.56 MHz) |
| Temperature | 300° C. |
| Inner pressure | 0.1 Torr |

TABLE 18

| Light receiving member | Wear loss (Å/10,000 sheets) | Hydrogen content (%) |
|---|---|---|
| G' | 0.8 | 40 |
| H' | 0.5 | 38 |
| I' | 0.1 | 35 |

Example 4

In the similar fashion to Example 1, using the plasma CVD apparatus illustrated in FIG. 3, the light receiving members J, K, L were produced by stacking the inhibiting layer and the photoconductive layer on the cylindrical conductive substrate under the conditions of Table 14 and thereafter depositing the surface layer in a thickness of 0.5 μm under the conditions of Table 19. Further, a-C:H surface layer samples of J to L were each prepared on the silicon wafer under the conditions of Table 19, and the hydrogen contents of the surface layers of J to L were measured by the similar method to that in Example 1.

As a result, the hydrogen contents of the surface 10 layers of the light receiving members J to L were the values shown in Table 20.

Next, each of these light receiving members J to L was mounted in the modified machine from the copying machine NP-6060 manufacture by CANON K. K., and the durability test was conducted under the conditions similar to those in Example 1. The blade, however, was the silicone rubber blade having the JIS hardness 80. The wear losses of the surface layers after this durability test are shown in Table 20.

The results obtained by the above evaluations are shown in Table 21 and Table 22.

As a result, the light receiving members J to L had neither the image defect of the linear pattern caused by the uneven scraping even after the durability test of 100,000 sheets nor the image defects due to cleaning failure, fusion, and the like at all. Further, concerning the image smearing, good image characteristics were obtained without provision of the heating means for the light receiving member.

TABLE 19

| Production Conditions for Surface Layer in Example 4 (Surface layer) | |
|---|---|
| $CH_4/H_2$ | 100 sccm/200 sccm |
| Power | 500 W (105 MHz) |
| Temperature (J) | 150° C. |
| Temperature (K) | 200° C. |
| Temperature (L) | 250° C. |
| Inner pressure | 50 mTorr |

TABLE 20

| Light receiving member | Wear loss (Å/10,000 sheets) | Hydrogen content (%) |
|---|---|---|
| J | 10 | 60 |
| K | 8 | 58 |
| L | 6 | 55 |

TABLE 21

| Light receiving member | Uneven scraping | Fusion | Cleaning failure |
|---|---|---|---|
| G | a | a | a |
| H | a | a | a |
| I | a | a | a |
| J | a | a | a |
| K | a | a | a |
| L | a | a | a |

TABLE 22

| Light receiving member | 10,000 sheets | 30,000 sheets | 50,000 sheets | 80,000 sheets | 100,000 sheets |
|---|---|---|---|---|---|
| G | a | a | a | a | a |
| H | a | a | a | a | a |
| I | a | a | a | a | a |
| J | a | a | a | a | a |
| K | a | a | a | a | a |
| L | a | a | a | a | a |

a: Good image without image smearing
b: Image in such a practically acceptable level that lines in the density of 7 lines/mm are not seen but lines in the density of 6 lines/mm are seen
c: Image possibly having image smearing in such a level that lines in the density of 5 lines/mm are not seen Comparative Example 4

In the similar fashion to Example 1, using the plasma CVD apparatus illustrated in FIG. 3, the light receiving members J', K', L' were produced by stacking the inhibiting layer and the photoconductive layer on the cylindrical conductive substrate under the conditions of Table 14 and thereafter depositing the surface layer in a thickness of 0.5 μm under the conditions of Table 23. Further, a-C:H surface layer samples of J' to L' were each prepared on the silicon wafer under the conditions of Table 23, and the hydrogen contents of the surface layers of J' to L' were measured by the similar method to that in Example 1.

As a result, the hydrogen contents of the surface layers of the light receiving members J' to L' were the values shown in Table 24.

Next, each of these light receiving members J' to L' was mounted in the modified machine from the copying machine NP-6060 manufacture by CANON K. K., and the durability test was conducted under the conditions similar to those in Example 1. The blade, however, was the silicone rubber blade having the JIS hardness 73. The wear losses of the surface layers after this durability test are shown in Table 24.

The results obtained by the above evaluations are shown in Table 25 and Table 26.

As a result, in the case of the a-C:H films where the wear loss was greater than 10 Å/10,000 sheets and the hydrogen content was greater than 60%, the uneven scraping, fusion, and image smearing were of the practically acceptable level after the durability test of 100,000 sheets, but they had low mechanical strength and thus showed occurrence of image defects of scratches in a white line pattern.

TABLE 23

| Production Conditions for Surface Layer in Comparative Example 4 (Surface layer) | |
|---|---|
| $CH_4/H_2$ | 100 sccm/200 sccm |
| Power | 500 W (105 MHz) |
| Inner pressure (J') | 50 mTorr |
| Inner pressure (K') | 30 mTorr |
| Inner pressure (L') | 10 mTorr |
| Temperature | room temperature |

TABLE 24

| Light receiving member | Wear loss (Å/10,000 sheets) | Hydrogen content (%) |
|---|---|---|
| J' | 20 | 66 |
| K' | 17 | 64 |
| L' | 12 | 62 |

TABLE 25

| Light receiving member | Uneven scraping | Fusion | Cleaning failure |
|---|---|---|---|
| G' | b | b | b |
| H' | b | c | c |
| I' | b | c | c |
| J' | b | b | c |
| K' | b | a | b |
| L' | b | a | b |

TABLE 26

| Light receiving member | 10,000 sheets | 30,000 sheets | 50,000 sheets | 80,000 sheets | 100,000 sheets |
|---|---|---|---|---|---|
| G' | a | a | a | b | c |
| H' | a | a | b | c | c |
| I' | a | b | c | c | c |
| J' | a | a | a | a | a |
| K' | a | a | a | a | a |
| L' | a | a | a | a | a |

a: Good image without image smearing
b: Image in such a practically acceptable level that lines in the density of 7 lines/mm are not seen but lines in the density of 6 lines/mm are seen
c: Image possibly having image smearing in such a level that lines in the density of 5 lines/mm are not seen As detailed above, according to the present invention, in the electrophotographic apparatus having the structure for scrape-cleaning the developer of the average particle diameter of 5 to 8 μm with the elastic rubber blade having the JIS hardness of not less than 70 nor more than 80, by using the light receiving member having the surface layer comprised of the non-monocrystalline hydrogenated carbon film in which the wear loss after copying steps of A4-size transfer sheets was not less than 1 Å/10,000 sheets nor more than 10 Å/10,000 sheets and in which the hydrogen content was not less than 41% nor more than 60%, it has become possible to allow the surface layer to uniformly wear without provision of the scrubbing means such as the cleaning roller for the surface layer and also to prevented remarkably the image density irregularities caused by the uneven scraping and the fusion of the developer.

In addition, by allowing the surface layer to uniformly wear in the range of not less than 1 Å/10,000 sheets nor more than 10 Å/10,000 sheets, it is possible to effectively prevent the image defects such as the image smearing and the image unfocussing even under any environments without provision of the means for directly heating the surface of the light receiving member.

Further, the present invention has enabled to remarkably extend the latitude of design of the electrophotographic apparatus, including the types of developers that can be used, compactification of the electrophotographic apparatus, reduction of cost, and so on.

The present invention involves all modifications and combinations falling in the scope of the spirit of the invention and it is needless to mention that the present invention is not limited to only the above-stated examples.

What is claimed is:

1. An electrophotographic apparatus comprising an electrophotographic photosensitive member, and a charger, an exposure mechanism, a developing device, a transfer mechanism, and a cleaning means provided around the electrophotographic photosensitive member, wherein the cleaning means comprises a blade with an elasticity of a hardness of not less than 70 nor more than 80 for scrape-cleaning a surface of the electrophotographic photosensitive member, wherein the surface of the electrophotographic photosensitive member is formed of non-monocrystalline carbon containing hydrogen atoms, and wherein the wear loss of the surface during passage of A4-size transfer sheets with a developing agent of an average grain diameter of 5 to 8 μm is not less than 1 Å/10,000 sheets nor more than 10 Å/10,000 sheets.

2. The electrophotographic apparatus according to claim 1, wherein the non-monocrystalline carbon is amorphous carbon.

3. The electrophotographic apparatus according to claim 1, wherein the non-monocrystalline carbon contains 41 to 60 atomic % of hydrogen atoms.

4. The electrophotographic apparatus according to claim 1, wherein the electrophotographic photosensitive member comprises a photoconductive layer and a surface layer in this order on a substrate, the surface layer comprising the non-monocrystalline carbon in the outermost surface.

5. The electrophotographic apparatus according to claim 4, wherein the electrophotographic photosensitive member further comprises a charge injection inhibiting layer between the substrate and the photoconductive layer.

6. The electrophotographic apparatus according to claim 4, wherein the photoconductive layer comprises a charge transport layer and a charge generating layer.

7. The electrophotographic apparatus according to claim 4, wherein the photoconductive layer comprises a non-monocrystalline material comprising silicon atoms as a matrix.

8. An electrophotographic method of successively carrying out the steps of charging, exposure, development, transfer, and cleaning on an electrophotographic photosensitive member, wherein the development is carried out by use of a developing agent of an average grain diameter of 5 to 8 μm and the cleaning is carried out by use of an elastic blade with a hardness of not less than 70 nor more than 80, wherein the surface of the electrophotographic photosensitive member comprises non-monocrystalline carbon containing hydrogen atoms, and wherein when the above mentioned steps are successively carried out with regard to A4-size transfer sheets, the above mentioned steps are carried out such that the wear loss of the surface of the electrophotographic photosensitive member is not less than 1 Å/10,000 sheets nor more than 10 Å/10,000 sheets.

9. The electrophotographic method according to claim 8, wherein the non-monocrystalline carbon is amorphous carbon.

10. The electrophotographic method according to claim 8, wherein the non-monocrystalline carbon contains 41 to 60 atomic % of hydrogen atoms.

11. The electrophotographic method according to claim 8, wherein the electrophotographic photosensitive member comprises a photoconductive layer and a surface layer in this order on a substrate, the surface layer comprising the non-monocrystalline carbon in the outermost surface.

12. The electrophotographic method according to claim 11, wherein the electrophotographic photosensitive member further comprises a charge injection inhibiting layer between the substrate and the photoconductive layer.

13. The electrophotographic method according to claim 11, wherein the photoconductive layer comprises a charge transport layer and a charge generating layer.

14. The electrophotographic method according to claim 11, wherein the photoconductive layer comprises a non-monocrystalline material comprising silicon atoms as a matrix.

15. An electrophotographic photosensitive member comprising a photoconductive layer and having a surface comprising non-monocrystalline carbon containing hydrogen atoms, the surface having a wear loss of not less than 1 Å nor more than 10 Å per 10,000 A4-size transfer sheets when effecting a process of carrying out charging, exposure, subsequent development with provision of a developing agent of an average grain diameter of 5 to 8 $\mu$m, subsequent transfer to a transfer sheet and subsequent scrape-cleaning with a blade having an elasticity of a hardness of not less than 70 nor more than 80.

16. The electrophotographic photosensitive member according to claim 15, wherein the non-monocrystalline carbon is amorphous carbon.

17. The electrophotographic photosensitive member according to claim 15, wherein the non-monocrystalline carbon contains 41 to 60 atomic % of hydrogen atoms.

18. The electrophotographic photosensitive member according to claim 15, wherein the electrophotographic photosensitive member comprises a photoconductive layer and a surface layer in this order on a substrate, the surface layer comprising the non-monocrystalline carbon in the outermost surface.

19. The electrophotographic photosensitive member according to claim 18, wherein the electrophotographic photosensitive member further comprises a charge injection inhibiting layer between the substrate and the photoconductive layer.

20. The electrophotographic photosensitive member according to claim 18, wherein the photoconductive layer comprises a charge transport layer and a charge generating layer.

21. The electrophotographic photosensitive member according to claim 18, wherein the photoconductive layer has a non-monocrystalline material comprising silicon atoms as a matrix.

* * * * *